United States Patent [19]

Muramoto

[11] 3,940,022

[45] Feb. 24, 1976

[54] DOUBLE-TYPE CONTAINER FOR COOLING BEVERAGE

[76] Inventor: Komi Muramoto, No. 17-4 8-chome Miyamoto-cho, Funabashi, 273, Japan

[22] Filed: Oct. 2, 1974

[21] Appl. No.: 511,163

[30] Foreign Application Priority Data

June 26, 1974 Japan ..... 49-74281
June 29, 1974 Japan ..... 49-75993

[52] U.S. Cl. ..... 222/130; 222/146 C; 222/465; 222/478

[51] Int. Cl.[2] ..... B67D 5/60

[58] Field of Search ..... 222/146 C, 146 H, 146 R, 222/465, 210, 323, 324, 130, 131, 478; 215/13 A, 12 A; 62/400

[56] References Cited

UNITED STATES PATENTS 551,797 12/1895 Statford ..... 222/130
1,162,426 11/1915 Wilkes ..... 222/465
2,075,831 4/1937 Schlumbohm ..... 222/146 R X

*Primary Examiner*—Allen N. Knowles
*Attorney, Agent, or Firm*—McGlew and Tuttle

[57] ABSTRACT

A container construction particularly for beverages which are to be cooled or heated comprising an outer spherical container body which has a supporting base portion which for example may be connected to a handle forming a cylindrical opening or recess for accommodating the cylindrical body. The cylindrical body includes pouring spout formed by an upstanding spout neck on one side of the vertical for example at 35° and it has an opposite inner container receiving opening disposed on the other side at 35° from the vertical which accommodates an inner cylindrical container which is closed at its inner bottom end. The inner container is supported at its outer end in a raised collar formation of the spherical outer container. The handle is held at the raised portion by an encircling belt which connects to the upper end of the handle.

2 Claims, 4 Drawing Figures

DOUBLE-TYPE CONTAINER FOR COOLING BEVERAGE

BACKGROUND OF THE INVENTION

Field of the Invention

This invention relates in general to the construction of containers and in particular to a new and useful container particularly for beverages which includes an outer spherical body portion having a pouring spout with a spout opening defined on the body extending upwardly on one side thereof and a receiving opening defined on the other side thereof with a cylindrical inner container extending through the opening and through the center of the outer body and being supported at the receiving opening.

The container according to the present invention comprises a spherical outer portion or body having respective spout and inner container receiving openings located at 35° at both left and right sides thereof with respect to the vertical plane passing through the center of the outer spherical container. The spout comprises an outlet port of small diameter. The receiving opening is defined within an outwardly projected collar. An annular belt is wound around the side surface of the collar and both end portions are clamped and secured firmly with bolts at the upper ends of grip handle fitted to the bedplate on which said spherical container is supported. A close bottomed cylindrical inner container is placed in an oblique position within the outer body, an annular belt fixed to the peripheral side face of the collar of the inner container being engaged therewith. A plurality of projected members or teeth are provided on the lower side end face of said annular belt, and a gap is formed between the upper end face of the opening and the engaging annular belt, whereby flowing-in-and-out of air becomes possible. Since the beverage within the cooled outer container is poured separately from its spouts into respective cups, dissolved water within the inner container can not spill off nor ice blocks fall off into the outer container, and the taste of the beverage in the outer container cannot be impaired.

Accordingly it is an object of the invention to provide a container particularly for beverages requiring heating or cooling which comprises a spherical outer body portion having a pouring spout extending outwardly and upwardly on one side thereof and a receiving opening on the other side into which a container is positioned which extends inwardly through the interior center of the outer container and which is adapted to contain another substance separately from the outer container.

A further object of the invention is to provide a container which is simple in design, rugged in construction and economical to manufacture.

For an understanding of the principles of the invention, reference is made to the following description of a typical embodiment thereof as illustrated in the accompanying drawings.

GENERAL DESCRIPTION OF THE PREFERRED EMBODIMENT

Figure 1:
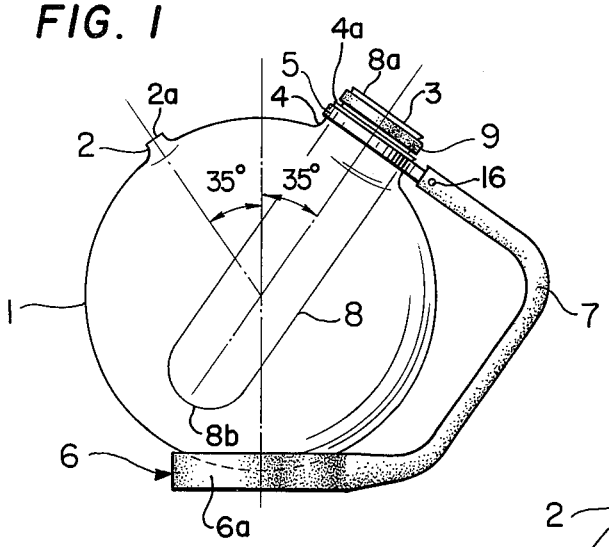
FIG. 1 is a side elevation showing a complete assembly of the container according to the present invention.
Figure 2:
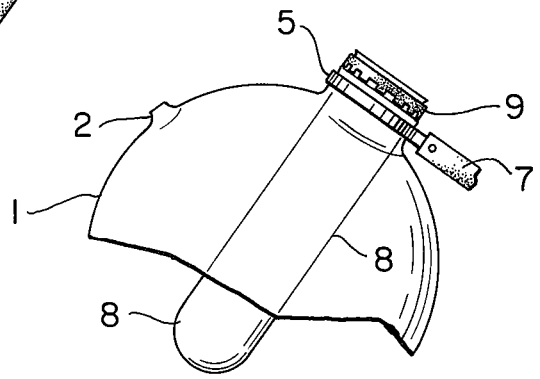
FIG. 2 is a partly enlarged diagram showing the same.
Figure 3:
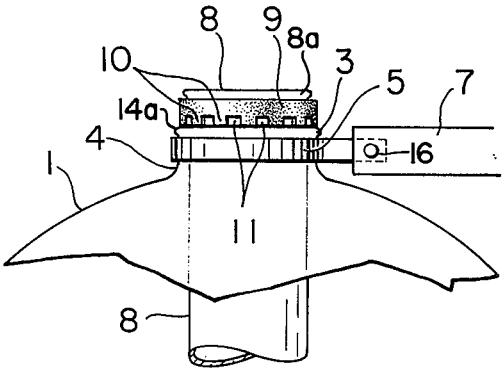
FIG. 3 is a partly enlarged diagram showing the same.

In the container according to the present invention, a liquid beverage such as coffee, juice or wines is placed within a glass-made spherical container or body 1 and, a bottomed cylindrical container 8 is filled with ice blocks and located in the spherical container to rapidly cool the beverage within the spherical container.

Referring to the drawings in particular the invention embodied therein comprises a container particularly for beverages which require heating or cooling and which includes an outer spherical container or body portion 1 which is supported in a cylindrical recess of a cylindrical base portion **6*a* of a handle 6.**

In accordance with the invention the spherical container 1 is provided with a pouring spout or outlet 2 having a relatively small size opening **2*a* located so as to extend upwardly on one side of the container 1. In addition the outer body or container 1 has an inner container receiving opening 12 defined within an upstanding cylindrical support projection 14.**

An inner container or closed bottomed cylinder 8 is inserted into the opening 12 and it has a flanged upper end 8a which is supported on the projection 14 so that the inner container 8 extends through the center of the outer spherical container 1 so that its closed end **8*b* is located adjacent the interior wall of the outer container 1. In the preferred arrangement the center line of the opening 2a is located at an angle 35° from the vertical and the center line of the container 8** is also located at an angle of 35° from the vertical.

In accordance with another feature of the invention the handle 6 includes a gripping portion 7 which is connected at its upper end to an annular metal belt 5 which has extending end portions which are connected to the handle by a rivet or screw connection 16. A holder belt 9 is arranged between the flange 8a and the top edge or rim 14a of the projection 14. The belt 9 carries a plurality of circumferentially spaced downwardly extending teeth 10 on its one edge which are separated by gaps 11 which define air flow passages between the teeth. The bottom edges of the teeth 10 bear against the flange **14*a*. Air gaps 11 permit a flow into the space between the bottom of the belt 9 and the outer surface of the container 8 and the projecting portion or collar 14.** This permits air to flow inwardly or outwardly at such locations.

With the inventive arrangement a liquid beverage such as coffee, juice, wine, etc. may be placed in the outer body 1 and the inner cylindrical container may be filled with a temperature control medium for example such as ice which will provide a coolant for the interior beverage but which will be separated from the beverage on the interior and thus will not contaminate the same. The construction of the pouring spout 2 in relation to the collar 14 wherein they are disposed at an angle of 35° to the vertical provides an optimal arrangement for the pouring of the beverage from the spherical container without disturbing the contents of the cylindrical container 8. Containers 1 and 8 are advantageously made of glass but they may be made of other materials also.

Figure 4:
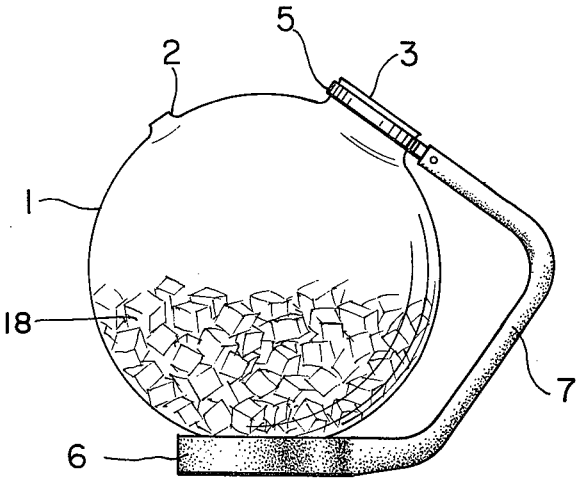
FIG. 4 is a partly enlarged diagram showing the same with cylindrical container removed.

When the inner cylindrical container 8 is removed as shown in FIG. 4 the outer container 1 may be used alone and ice cubes 18 for example may be inserted into the container through the large opening 3 within the collar 14. Thus the other container 1 may be used as a water pitcher or an ice pail or the like.

It is also possible to connect the inner container 8 to the outer spherical container 1 at the location of the collar 4 so that they form a vacuum seal together and both the inner container 8 and the outer container 1 may be designed as vacuum bottles.

While a specific embodiment of the invention has been shown and described in detail to illustrate the application of the principles of the invention, it will be understood that the invention may be embodied otherwise without departing from such principles.

What is claimed is:

1. A container comprising a closed container outer body having a supporting base portion, a pouring spout having a spout opening defined on said body extending upwardly to one side thereof, a receiving opening defined on said body on the opposite side thereof from said spout, and a cylindrical container extending through the receiving opening and through the center of said outer container body and supported on said outer container body and having an inner closed end, said closed outer container body comprising a spherical member, said pouring spout comprising a raised substantially cylindrical projection from the surface of said outer container body, said outer cylindrical body having an outwardly extending collar forming the rim around said receiving opening, said supporting base portion comprising a handle having a flattened base part supporting said spherical outer container body, an intermediate handle part and an upper part engaged around said collar, said handle including an encircling belt portion extending around said collar, said inner container having a belt therearound with downwardly projecting circumferentially spaced teeth engaged on the edge of said collar, the space between said teeth defining an air gap for the flow of air between said outer container body collar and said inner container.

2. A container according to claim 1, wherein said inner container has a top flange supported on said encircling belt, said belt resting on the top edge of said collar.

* * * * *